US005956806A

United States Patent [19]

Tutikawa

[11] Patent Number: 5,956,806

[45] Date of Patent: Sep. 28, 1999

[54] APPARATUS FOR AUTOMATICALLY CLOSING A SWING DOOR

[75] Inventor: Yoshiji Tutikawa, Osaka, Japan

[73] Assignee: Daiyasu Metal Industry Co., Ltd., Osaka, Japan

[21] Appl. No.: 08/865,177

[22] Filed: May 29, 1997

[51] Int. Cl.[6] ..... E05F 3/02

[52] U.S. Cl. ..... 16/66; 16/49

[58] Field of Search ..... 16/49, 51, 52, 16/56, 61, 66

[56] References Cited

U.S. PATENT DOCUMENTS

| | | | |
|---|---|---|---|
| 1,898,609 | 2/1933 | Anderson | 16/61 |
| 3,042,957 | 7/1962 | Muessel et al. | 16/49 |
| 3,143,757 | 8/1964 | Quinn | 16/52 |
| 3,531,820 | 10/1970 | Koivusalo | 16/52 |
| 4,102,006 | 7/1978 | Jenkins | 16/66 |
| 5,170,530 | 12/1992 | Kopec et al. | 16/52 |

FOREIGN PATENT DOCUMENTS

| | | | |
|---|---|---|---|
| 1194140 | 6/1970 | United Kingdom | 16/52 |
| 1252757 | 11/1971 | United Kingdom | 16/52 |
| 1263666 | 2/1972 | United Kingdom | 16/52 |

*Primary Examiner*—Chuck Y. Mah
*Assistant Examiner*—Donald M. Gurley
*Attorney, Agent, or Firm*—McDermott, Will & Emery

[57] ABSTRACT

A door closer has a cylindrical body 'A' installed in a swing door and a base plate 'B' fixed to a wall 'C' standing still and near the door. The body 'A' has an oil-hydraulic third cylinder 3 fixed by a connecting pin 4 in a second cylinder 2, which slides in a first cylinder 1 serving as an outer casing. A piston rod 7 displaceable into and out of the third cylinder has a front end fixed to a piston 5 in this, and a rear end fixed to a piston 6 at rear end of the second cylinder. A tie rod 9 connects the second cylinder's front end to the base plate, and an airtight chamber 10 is defined between the piston 6 and the first cylinder's inner end wall. An air suction passage 12 is formed through which the chamber communicates with atmosphere, a one-way valve 11 disposed in the passage allows only suction of air into the chamber, and a thin ventilation hole 13 communicates with the airtight chamber.

3 Claims, 6 Drawing Sheets

APPARATUS FOR AUTOMATICALLY CLOSING A SWING DOOR

FIELD OF THE INVENTION

The present invention relates to an apparatus for automatically closing a swing door, wherein the apparatus installed in the swing door is designed such that the latter is protected from being shut abruptly or violently.

PRIOR ART

The swing doors or swinging doors have sometimes been provided with the so-called 'door closers' secured to the upper parts of the doors. Each door closer prevents the swing door from abruptly closing to make a noise or exert a shock to a door holding frame or the like.

Many of the prior art door closers have a body for accommodation of an oil-hydraulic mechanism. An end of the door closer body is secured to an upper part of door. One of the links forming an L-shaped or V-shaped swingable arm extends from another end of the door closer body. The other link of the swingable arm has an end located remote from the body and connected to a wall adjacent to the door. The other link can thus expand and contract relative to the one link. It is however noted that those prior art door closers are so large in size and so heavy in weight. Therefore, it has not necessarily been easy to attach them to the swing doors lest their bodies and swingable arms should ugly jut from the doors.

SUMMARY OF THE INVENTION

An object of the present invention is therefore to provide an automatic door closing apparatus of a novel, compact and simple structure such that it can almost entirely be installed snugly in the door and can be manufactured at a lower cost.

In accordance with the present invention, the apparatus (hereinafter referred to simply as 'door closer') comprises two cylinders telescopically arranged one in another, coaxial with each other and held in a common cylindrical casing. Typically, one of the cylinders is of an oil-hydraulic type and the other is of a pneumatic type.

THE PREFERRED EMBODIMENTS

Figure 1:
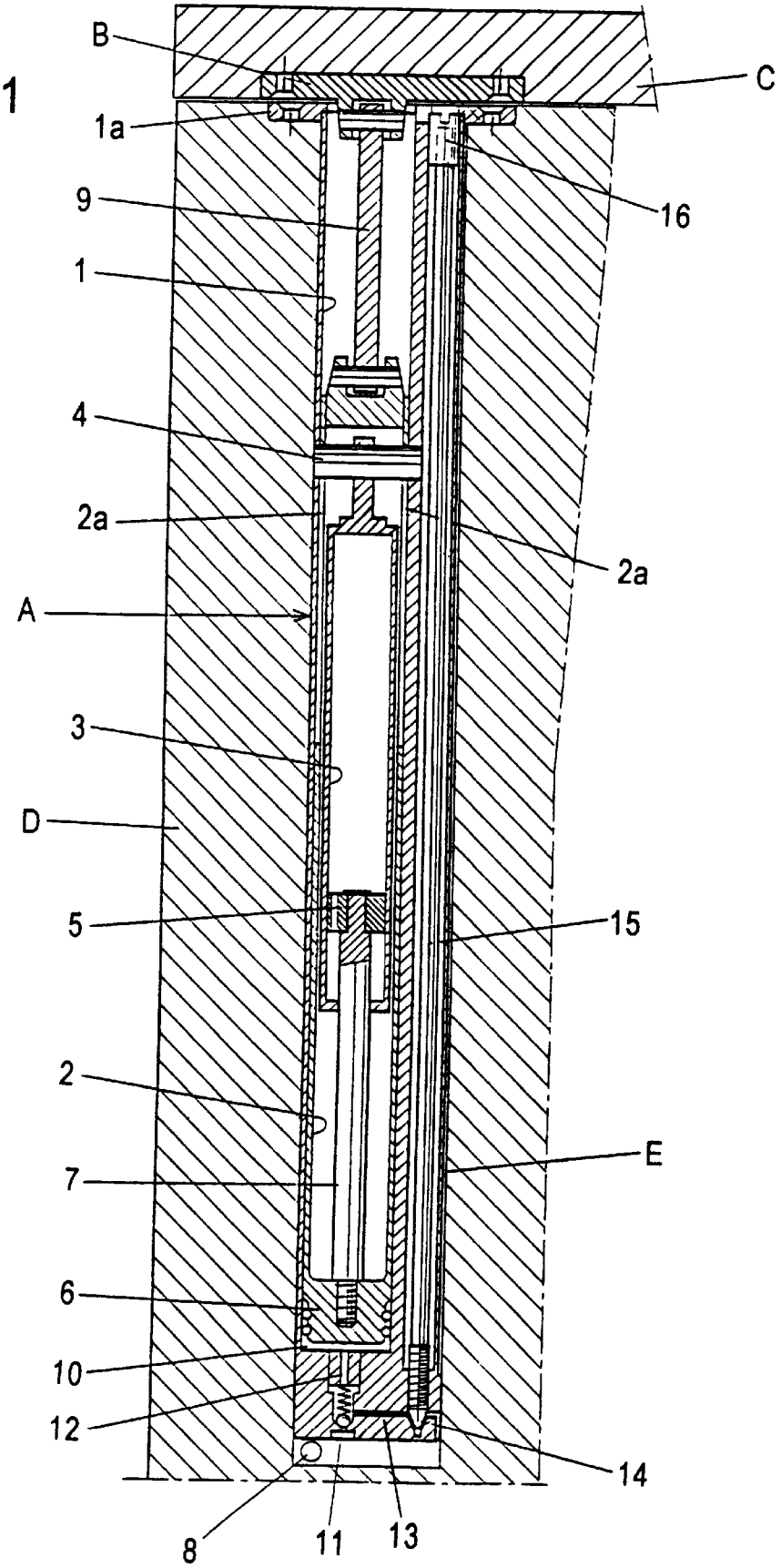
FIG. 1 is a vertical cross section of an apparatus for automatically closing a swing door provided in an embodiment, in which the apparatus is installed in the door and connected to a wall standing still.

Some embodiments of the invention will now be described in detail referring to the drawings. In a first embodiment shown in FIGS. 1 to 4, a door closer for a swing door 'D' comprises a cylindrical body 'A' to be installed in the door. The door closer further comprises a base plate 'B' to be fixed to a wall 'C' standing still and adjacent to the door. The reference numeral 1 denotes a first cylinder that serves substantially as an outer casing for accommodation of other members constituting the door closer. A flange 1*a* is secured to a front end (viz., right-hand end in FIG. 1) of the first cylinder 1, so as to surround an end opening thereof. This flange 1*a* is for attachment of the door closer to the swing door 'D'. A second cylinder 2 (of a pneumatic type) is disposed in the first cylinder 1 and capable of sliding a given stroke within and longitudinally of the latter. A third cylinder 3 of an oil-hydraulic type is held in the second cylinder 2, and a connecting pin 4 holds the third cylinder in position immovable relative to the first cylinder 1.

A pair of elongate apertures 2*a* formed in opposite wall portions of the second cylinder 2 extend longitudinally thereof. The connecting pin 4 penetrates those longitudinally elongate apertures 2*a* such that the second cylinder 2 are guided by them to slidingly reciprocate between inner and outer ends of the apertures.

The door closer further includes a piston rod 7 and a tie rod 9. A piston 5 held in the third oil-hydraulic cylinder 3 is fixed on a front end (viz., right-hand end in FIG. 1) of piston rod 7. This piston rod 7 is displaceable into and out of the third cylinder 3, when the door closer operates. Fixed to a rear end of the piston rod 7 is a piston-shaped part 6, which is located at a rear end of the second cylinder 2 so as to serve as a piston thereof. The tie rod 9 connects a front end of the second cylinder 2 to the base plate 'B' mentioned above.

The oil-hydraulic third cylinder 3 is of the conventional closed type. Therefore, a difference in the front and rear pressure receiving areas of the piston 5 causes it to always urge backward the piston rod 7.

There is a substantially airtight chamber 10 defined between the piston-shaped part 6 of second cylinder 2 and the inner surface of a rear end wall of the first cylinder 1. Such an airtight chamber 10 communicates with atmosphere through an air suction passage 12 in which a one-way valve 11 is disposed. This valve 12 is intended to allow only air suction into the airtight chamber 10. A thin ventilation hole 13 communicates with this chamber 10, so that the air compressed therein will be discharged slowly to the atmosphere when the door is closed.

The apparatus further comprises an airflow regulating valve 14. The air discharging rate out of the chamber 10 is determined by this valve 14. A rotatable rod 15 integral with the regulating valve is fixed to a knob 16. This knob 16 is disposed beside the frontal end of first cylinder 1 and exposed to the outside. The flow rate of discharged air can be adjusted by manually turning the knob with a driver or the like tool.

Figure 2:
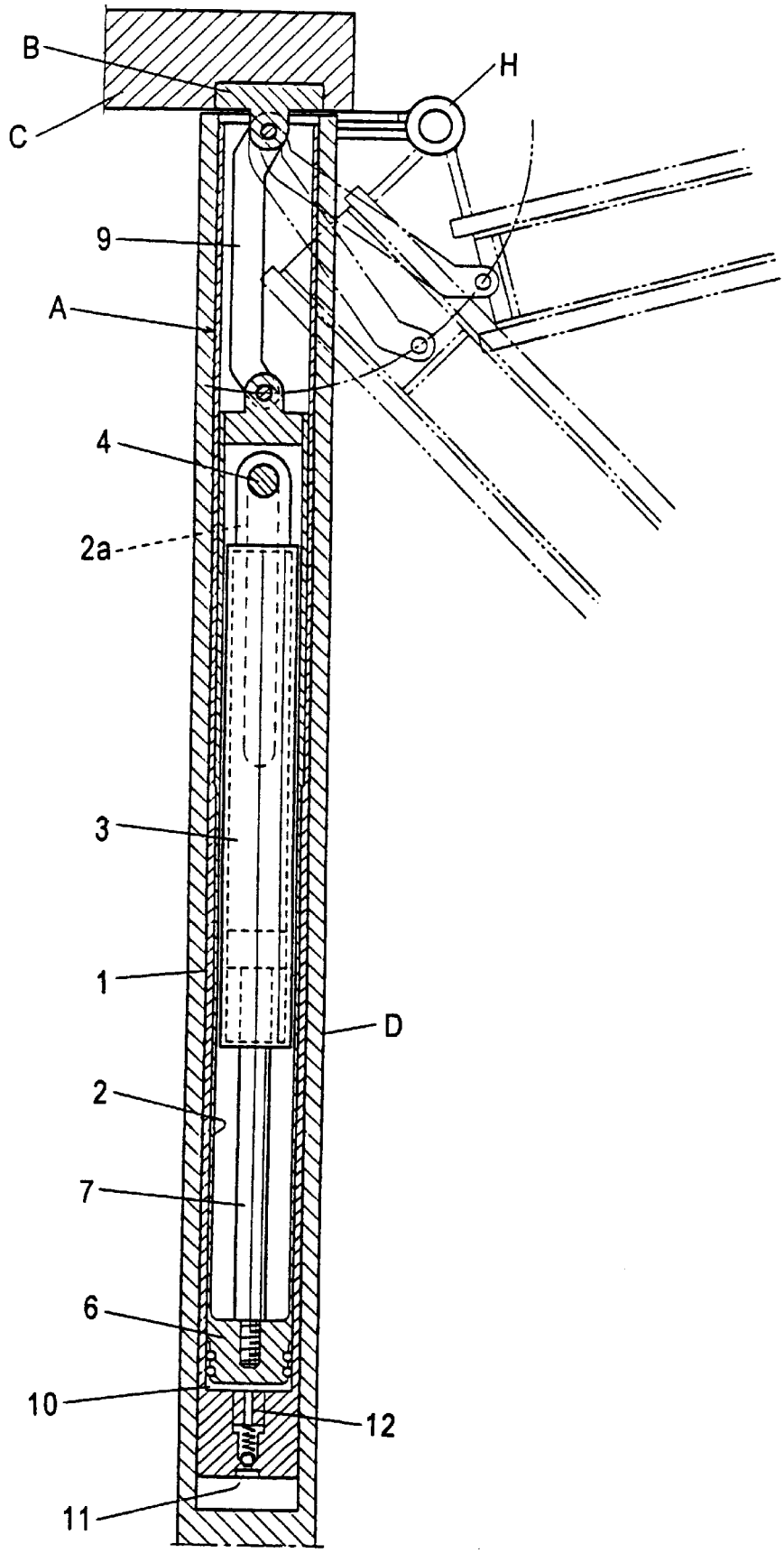
FIG. 2 is a horizontal cross section of the apparatus shown in FIG. 1.
Figure 3:
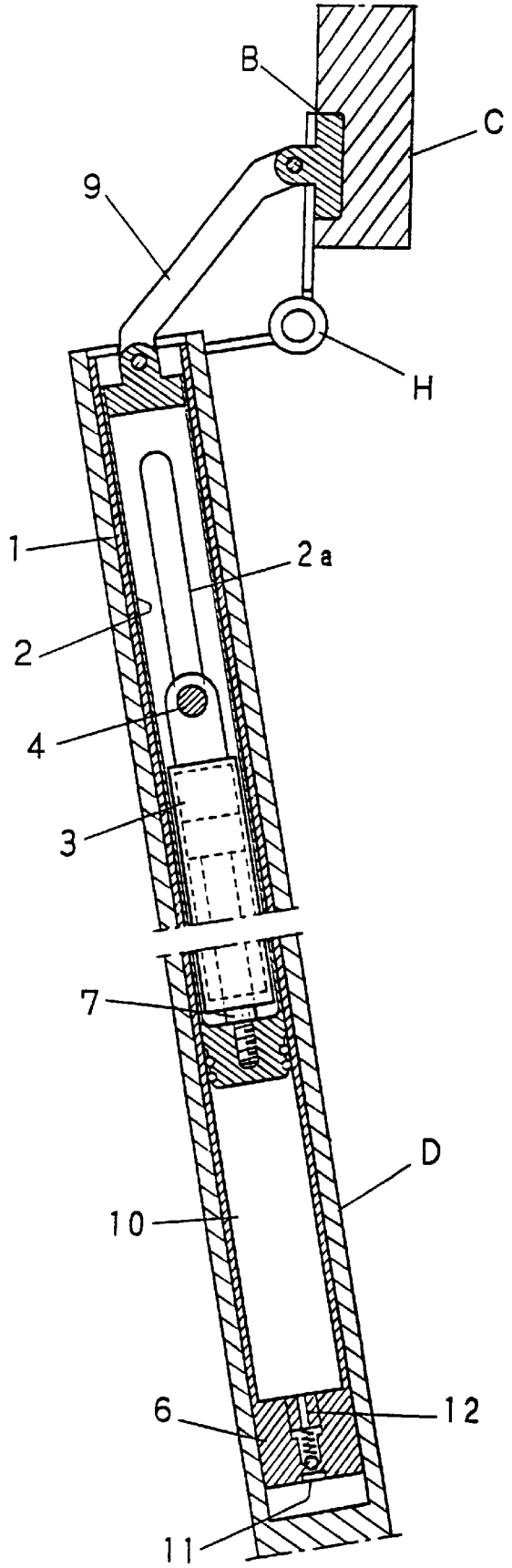
FIG. 3 is a horizontal cross section of the apparatus shown in its open state.
Figure 4:
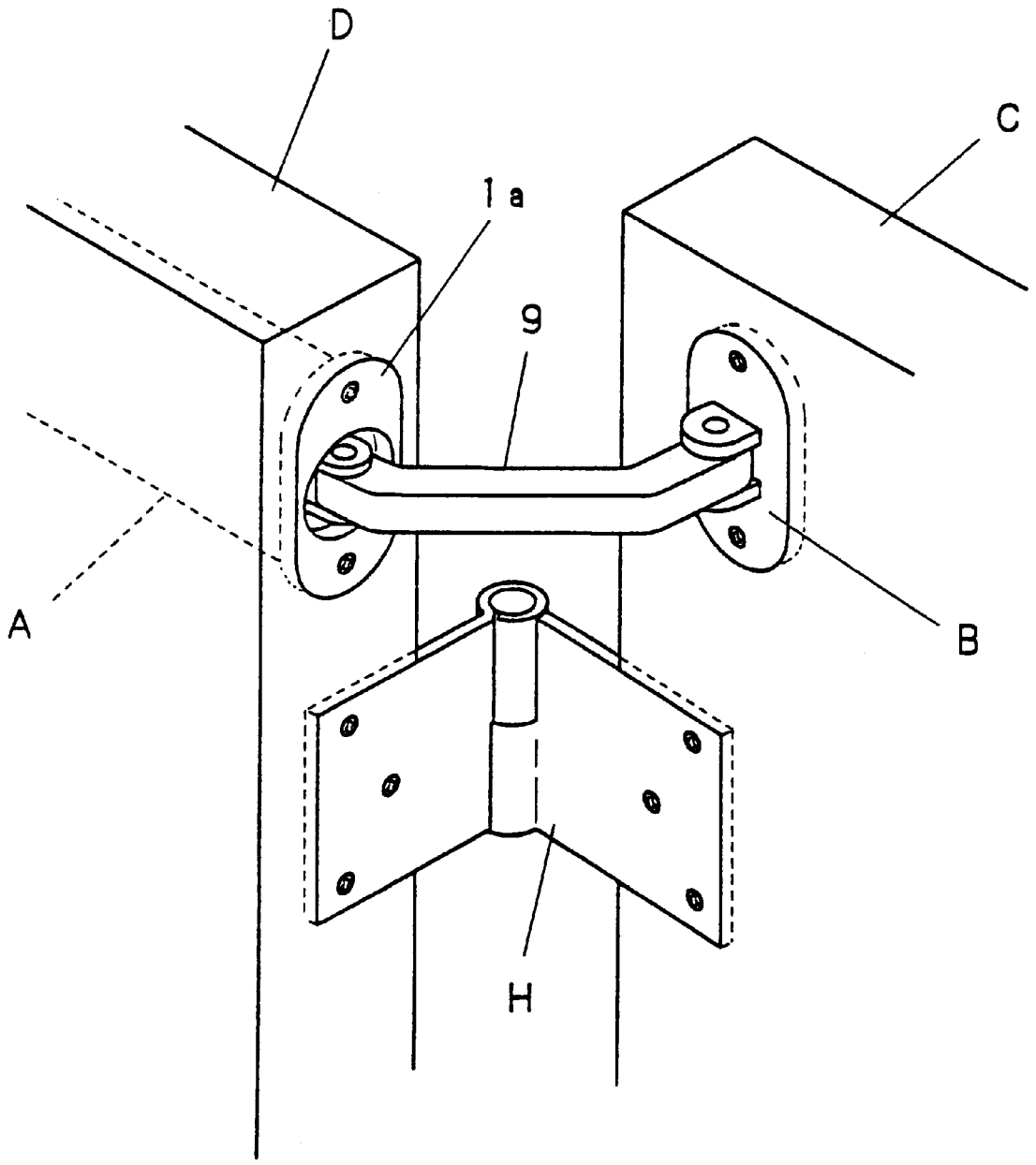
FIG. 4 is a perspective view corresponding to FIG. 3, but illustrating only some parts of the apparatus.
Figure 5:
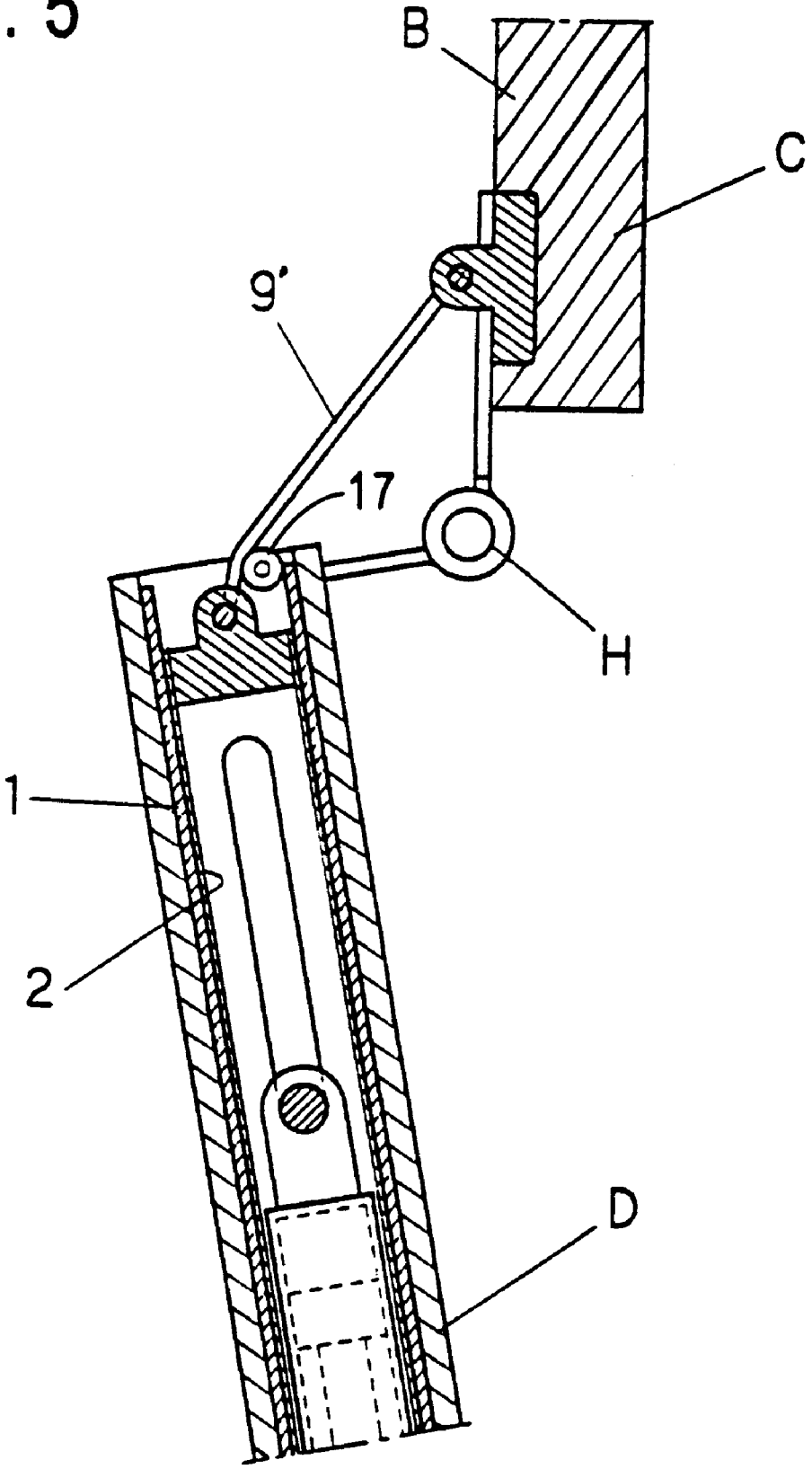
FIG. 5 shows in cross section another embodiment in a manner corresponding to FIG. 3.

A cylindrical recess or bore 'E' will be formed in a horizontal direction to open in an inner side of the swing door 'D'. A hinge 'H' for pivotally connecting the door to the wall will be disposed near the end opening of said cylindrical bore 'E'. The cylindrical body 'A' of the door closer is thus inserted in the bore 'E'. Then, the flange 1*a* will be bolted to the door side, with the base plate 'B' being also bolted to the wall 'C'. In operation, a user may pull or push the door standing closed as shown in FIGS. 1 and 2, towards an open position shown in FIG. 3. While the door is being opened in this manner, the tie rod 9 will force forwards the second cylinder 2 as will be seen best in FIG. 3. This motion of second cylinder will cause the piston rod 7 to press forwards the piston 5 of oil-hydraulic cylinder 3, towards its closed end. With the door being freed thereafter, a differential pressure that has thus been imparted to the piston of third cylinder 3 will urge the piston rod 7 towards its home position. In consequence, the swing door 'D' will continue to move towards its closed position. In such a returning process, the air sucked into the chamber 10 will now be compressed and gradually discharged through the thin ventilation hole 13. Since the piston rod 7 is hindered in this way from rushing backward, the door will be closed tenderly. The speed at which the door is closed can be adjusted easily, by rotating the knob 16 to render the regulating valve 14 more opened or more closed. It may also be possible to fully close this valve 14 while the door is open, in order to let the door remain open, if so desired.

It will be understood that the cylindrical body 'A' need not necessarily be embedded in the swing door 'D' to hide therein the door closer almost in its entirely and to thereby make snug the door. Because the body 'A' is of a simple and compact design, it can alternatively be attached to the outer surface of door, without intolerably impairing its look.

Figure 6:
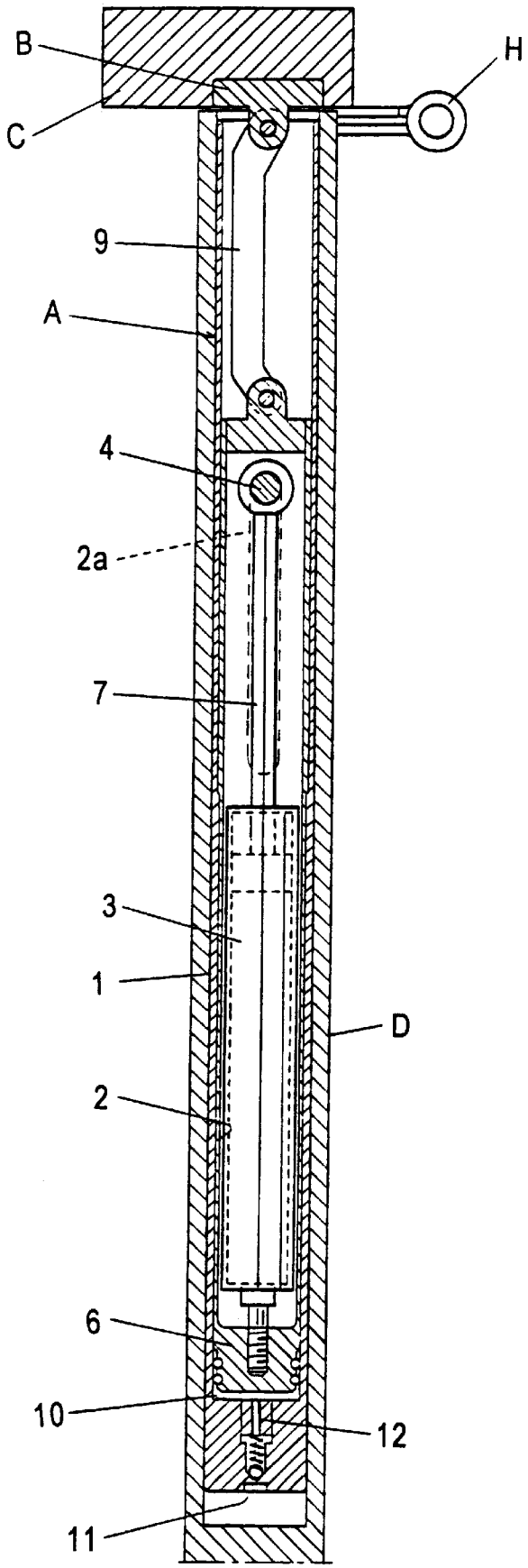
FIG. 6 also shows in cross section still another embodiment in a manner corresponding to FIG. 2.

A modification in the position of the oil-hydraulic cylinder 3 is possible if desired, disposing it not in front of but in rear of the piston rod 7. In this case, the third cylinder 3 will have its rear end fixed to the piston-shaped part 6 formed as the rear end of second cylinder 2. The frontal end of piston rod 7 extending from the third cylinder 3 will be connected by the connecting pin 4 to the first cylinder 1, as seen in FIG. 6. It is apparent that the apparatus as modified in this manner will also operate in the same manner as that in the first embodiment.

The tie rod 9 may be replaced with a flexible cord or string 9'. It will be preferable to mount a guide roller 17 on the rim of end opening of the first cylinder 1, for the purpose of a smoother motion of the cord or string.

The apparatus described above can be modified further in any other ways, within limits not prejudiciary to the essential functions and effects of the present invention. In an example of such modifications, the knob 16 may be of a type operable directly with a user's hand.

In summary, the body enclosing various members of the door closer is cylindrical and streamlined so that almost all the members can be installed snugly in the swing door. Further, the door closer is so simple in structure that it can be manufactured inexpensively for offer to many users at a reasonable price.

In the particular embodiment defined in the accompanying claim 3, the knob may be used to adjust the opened extent of the regulating valve in such a manner that the speed at which the door automatically closes is changed freely, or the door is caused to remain open if or when so desired.

What is claimed is:

1. An apparatus for automatically closing a swing door, comprising: a cylindrical body designed for installation in the door; and a base plate to be fixed to a wall; the cylindrical body comprising:

a first cylinder that serves substantially as an outer casing for accommodation of other members constituting the apparatus and defined below;

a second cylinder disposed in the first cylinder and capable of closing a given stroke within and longitudinally of the latter;

a third oil-hydraulic cylinder accommodated in the second cylinder and secured to the first cylinder by a connecting pin;

a piston rod held to be displaceable into and out of the third cylinder, having a front end fixed to a piston in the third cylinder, and having a rear end fixed to a piston-like part which is located at a rear end of the second cylinder;

a tie rod connecting a front end of the second cylinder to the base plate;

a substantially airtight chamber defined between the piston-like part of second cylinder and an inner surface of a rear end wall of the first cylinder;

an air suction passage through which the chamber communicates with atmosphere;

a one-way valve disposed in the air suction passage so as to allow only suction of air into the chamber; and a thin ventilation hole communication with the airtight chamber, so that the air compressed therein is discharged slowly to the atmosphere, wherein the third cylinder is such that the piston rod is urged towards a home position thereof when freed after pressed deep into the third cylinder.

2. An apparatus for automatically closing a swing door, comprising: a cylindrical body designed for installation in the door; and a base plate to be fixed to a wall; the cylindrical body comprising:

a first cylinder that serves substantially as an outer casing for accommodation of other members constituting the apparatus and defined below;

a second cylinder disposed in the first cylinder and capable of sliding a given stroke within and longitudinally of the latter;

a third oil hydraulic cylinder accommodated in the second cylinder and having an end secured to a piston-like part formed at a rear end of the second cylinder;

a piston rod held to be displaceable into and out of the third cylinder, having a rear end fixed to a piston in the third cylinder, and having a front end connected by a connecting pin to the first cylinder;

a tie rod connecting a front end of the second cylinder to the base plate;

a substantially airtight chamber defined between the piston-like part of second cylinder and an inner surface of a rear end wall of the first cylinder;

an air suction passage through which the chamber communicates with atmosphere;

a one-way valve disposed in the air suction passage so as to allow only suction of air into the chamber; and a thin ventilation hole communicating with the airtight chamber, so that the air compressed therein is discharged slowly to the atmosphere, wherein the third cylinder is such that the piston rod is urged towards a home position thereof when freed after pressed deep into the third cylinder.

3. An apparatus as defined in claim 1, further comprising:

an airflow regulating valve disposed in the thin ventilation hole; and a rotatable rod integral with the regulating valve and fixed to an exposed knob disposed beside a front end of the first cylinder.

* * * * *